United States Patent [19]

Hyca

[11] Patent Number: 4,922,843

[45] Date of Patent: May 8, 1990

[54] USING A VARIABLE SPEED MOTOR IN A TAPE FEED DEVICE FOR A SEWING MACHINE

[75] Inventor: Bohumil Hyca, Korntal-Munchingen, Fed. Rep. of Germany

[73] Assignee: Union Special G.m.b.H., Stuttgart, Fed. Rep. of Germany

[21] Appl. No.: 190,206

[22] Filed: May 4, 1988

[30] Foreign Application Priority Data

May 14, 1987 [DE] Fed. Rep. of Germany ..... 3716148

[51] Int. Cl.[5] ..... D05B 27/16; D05B 35/06

[52] U.S. Cl. ..... 112/318; 112/121.27; 112/130; 112/152; 112/307; 112/322; 226/183; 226/42

[58] Field of Search ..... 28/170; 112/318, 152, 112/130, 121.26, 121.27, 307, 113, 262.3, 322; 226/108, 183, 42

[56] References Cited

U.S. PATENT DOCUMENTS

| | | | |
|---|---|---|---|
| 3,506,176 | 4/1970 | Brown | 226/183 |
| 3,847,099 | 11/1974 | Brown | 112/121.26 X |
| 4,318,360 | 3/1982 | Vemura et al. | 112/318 |
| 4,389,951 | 6/1983 | von Hagen | 112/121.27 |
| 4,545,544 | 10/1985 | Rockerath et al. | 112/121.26 X |
| 4,590,874 | 5/1986 | Baclagis | 112/121.26 |

FOREIGN PATENT DOCUMENTS

| | | | |
|---|---|---|---|
| 978035 | 11/1975 | Canada | 112/121.26 |
| 2402055 | 7/1975 | Fed. Rep. of Germany . | |

*Primary Examiner*—Andrew M. Falik

*Attorney, Agent, or Firm*—Powell L. Sprunger

[57] ABSTRACT

A tape feed device for a sewing machine for feeding to a sewing location of the sewing machine at least one tape from a supply having a drive roll for feeding the tape, a feed roll disposed in the path of the tape between the supply and the drive roll, a stepping motor for driving both the drive roll and the feed roll, and a guide for passing tape around at least part of the feed roll which is capable of feeding more tape than the drive roll.

8 Claims, 2 Drawing Sheets

USING A VARIABLE SPEED MOTOR IN A TAPE FEED DEVICE FOR A SEWING MACHINE

BACKGROUND OF THE INVENTION

The present invention relates to tape feed devices for a sewing machine.

One such tape feed device is known from German Offenlegungsschrift No. 34 25 939 corresponding to U.S. Pat. No. 4,590,874. This device contains an electromechanical transducer, which is subjected to mechanical deformation by the force generated by the tape tension, which deformation is converted into an electrical signal. This signal is further processed and controls a drive roll to keep the tape tension constant. Although the tension adjuster is of a very complex design, there is the disadvantage that different tape tensions coming from the tape supply have a direct effect on the drive roll and hence a bad influence on the sewn product.

Another tape feed device is described in German Offenlegungsschrift No. 24 02 055. In this device, the speed of a drive roll is controlled by means of an arm, which is disposed between rolls, by way of a complex control device. This tape feed device also does not have any means for compensating for fluctuations in tape tension ahead of the drive roll.

It is particularly desirable to have a small and constant a tape tension as possible ahead of the drive roll is elastic tape with a defined tension is to be sewn into a workpiece, since fluctuations in tape tension can lead to changs in the length of the tape to be worked.

SUMMARY OF THE INVENTION

The present invention relates to an improved tape feed device for a sewing machine.

The feed device of the present invention comprises, a supply of tape, a drive roll for feeding the tape, a feed roll disposed in the path of the tape between the supply and the drive roll, means for driving both the drive roll and the feed roll, and guide means for passing tape around at least part of the feed roll which is capable of feeding more tape than the drive roll.

A feature of the present invention is that the tape can be fed in a simplified manner to the drive roll with the tape tension being as constant and small as as possible.

Another feature of the present invention is that a feed roll may be used that has a peripheral speed greater than the drive roll, such that it conveys more tape than the drive roll, and the tape can be fed to the drive roll with a substantially constant low tension, since, even with a low tape tension between the two rolls or between the supply and the rolls, the tape winds firmly around the drive roll and sufficient tape is delivered from the supply.

Yet another feature of the invention is the provision of knives for cutting tape disposed in the region of the drive roll.

Further features will become more fully apparent in the following desription of the embodiments of this invention and from the appended claims.

DESCRIPTION OF THE PREFERRED EMBODIMENTS

Figure 1:
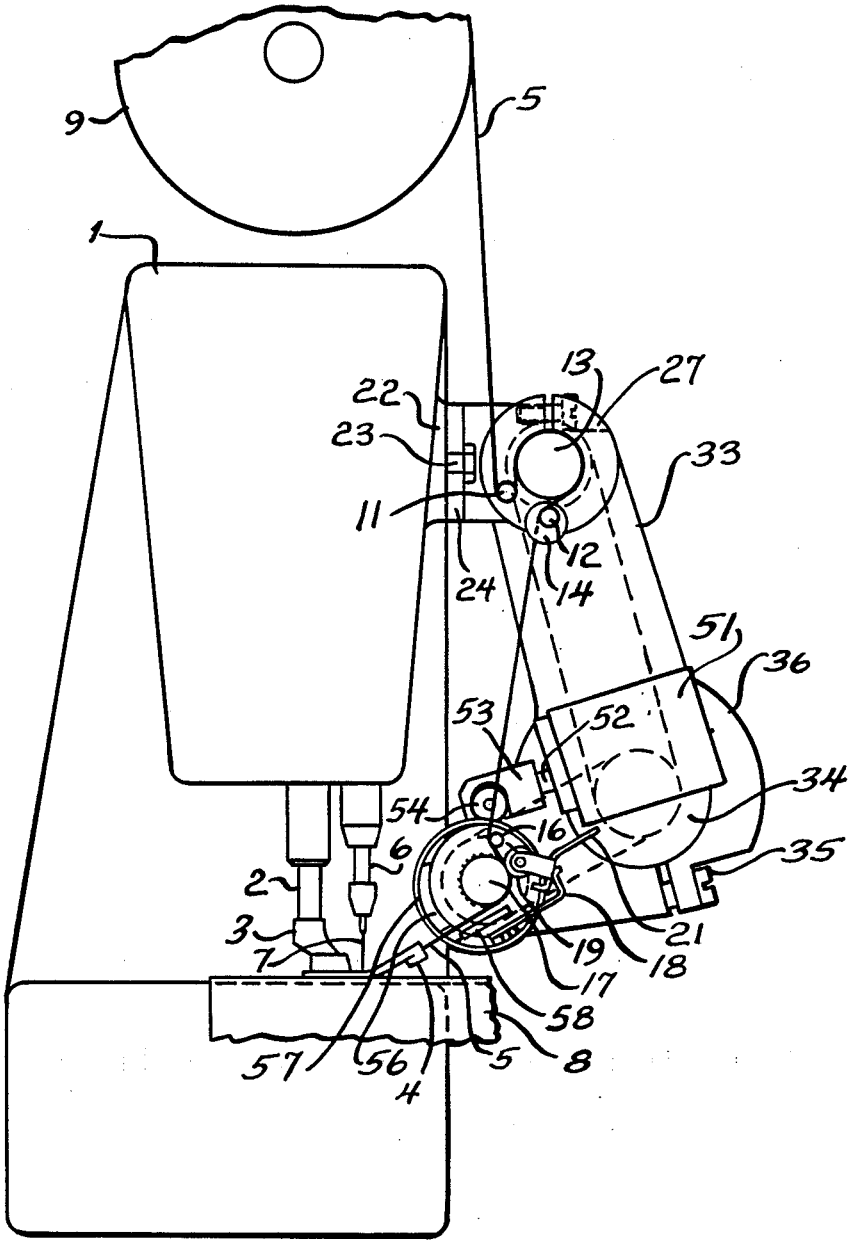
FIG. 1 is a side view of a tape feed device of the present invention as mounted on a sewing machine.
Figure 2:
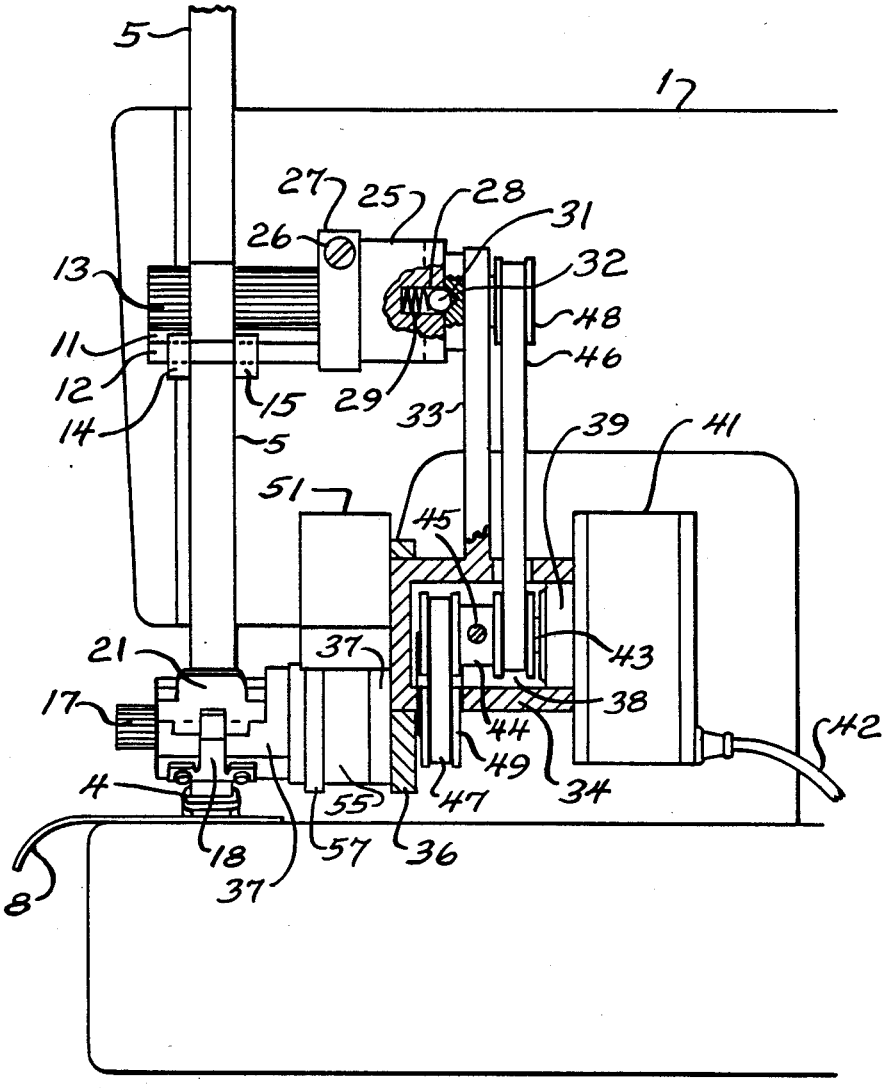
FIG. 2 is a front view taken partly in section of the tape feed device of FIG. 1.

As shown in FIGS. 1 and 2, a tape feed device is disposed on a housing 1 of a sewing machine. The sewing machine has secured to a resilient presser rod 2 a presser foot 3 having a funnel-shaped opening 4 for a tape 5. A needle bar 6, which is mounted in the housing 1 and moves in a reciprocating manner, carries a needle 7 which passes through both the tape 5 and the workpiece 8 during a sewing operation.

The tape 5 delivered from a supply 9 passes around two deflecting guides 11 and 12 and a feed roll 13, whose effective diameter is larger than that of a drive roll 17. The tape 5 is guided at the side by adjusting rings 14 and 15 respectively, which are secured on the deflecting guide 12. A further deflecting guide 16 guides the tape 5 between the drive roll 17 and a roll 19 which is pressed onto the tape 5 by means of a leaf spring 18. To faciliate insertion of the tape 5, the roll 19 has a manual control 21 by which the roll 19 can be lifted off the tape 5 or the small drive roll 17.

The housing 1 has a boss 22 to which a cranked support 24 is fastened by a screw 23. The cranked support 24 carries an annular hollow body 25 in which the feed roll 13 is rotatably mounted. A slit ring 27, which carries the two deflecting guides 11 and 12, is secured to the annular hollow body 25 by a screw 26. A pressure spring 29 is located in a side opening 28 in the annular hollow body 25 and presses a ball 31 into one of a plurality of recesses 32 in a holder 33 disposed concentrically to the feed roll 13. Due to the plurality of the recesses 32 in holder 33 disposed concentrically to feed roll 13 and due to the spring clamped ball 31 it is possible to set holder 33 in predetermined registered positions, such that the feed roll holding member (holder 33) is pivotally mounted on the machine housing.

The lower end of the holder 33 carries a partly hollow bearing boss 34 on which a holder 36 is secured by a screw 35 as shown in FIG. 1. When loosening the screw 35, it is possible to adjust the holder 36 relative to the holder 33 thus forming a joint. A hollow support element 37 is secured to the side of the holder 36 and the drive roll 17 is rotatably mounted herein.

A collar 39 of a stepping motor 41 projects into a receiving opening 38 of the bearing boss 34, the stepping motor being connected by way of a cable 42 to a control device.

A shaft 43 of the stepping motor 41 carries a double toothed belt pulley 44, which is fastened to the shaft 43 by a screw 45. Toothed belts 46 and 47 respectively drive the feed roll 13 and the drive roll 17 by way of further toothed belt pulleys 48 and 49. The effective diameter of the double toothed belt pulley 44 is the same as that of the other toothed belt pulleys 48 and 49. As a result, the feed roll 13 has a greater peripheral speed than the drive roll 17. As the ratio between the toothed belt pulleys is 1:1:1 and due to the fact that the effective diameter of the feed roll 13 is larger than that of the drive roll 17 the peripheryal speed of the feed roll 13 is greater as compared to the peripheral speed of the drive roll 17. Therefore, feed roll 13 is capable of feeding more tape than the drive roll 17.

A piston and cylinder mechanism 51, which is acted upon be pressure medium and which is controlled by way of supply lines, actuates by way of a piston rod 52 and a forked head 53 a roll 54 which is mounted on a knife holder 55 pivotable about the support element 37.

A curved knife 56 is detachably fastened by a tensioning ring 57 to the pivotable knife holder 55. A further knife 58 is carried by the support element 37. The two knives 56 and 58 are disposed about the drive roll 17.

The tape feed device operates as follows:

When the tension of the tape 5 between the drive roll 17 and supply 9 increases, the loose tape 5 becomes tight about the feed roll 13. As a result, more tape 5 is delivered from the supply 9 until tape 5 is being provided to the drive roll 17 with a constant, low tension. Once this has been achieved, the tape 5 winds loosely about the feed roll 13 again and tape is actually conveyed only by the drive roll 17, until the tension between the drive roll 17 and supply 9 increases again.

With this tape feed deivce, it is possible to apply tape 5 to the work material 8 both with and without pre-tension, since the pre-tension between the drive roll 17 and needle 7 is controlled by the stepping motor 41. The feed roll 13 ensures that tape 5 is fed evenly to the drive roll 17.

The joint which is formed between the holders 33 and 36, makes it possible to align the drive roll 17 precisely with the needle 7 and presser foot 3 of the sewing machine.

In order to provide ready access to the sewing location for service and attention, the tape feed device is pivotably about the axis of the roll 13 and can be resiliently retained in predetemrined registered positions in front of the sewing location of the sewing machine.

The knives 56 and 58 disposed about the drive roll 17 enable the tape 5 to be cut immediately adjacent to the sewing location. The tape feed device can be resiliently adapted to feed two or more tapes of the same or differing widths.

The foregoing detailed description is given for clearness of understanding only, and no unnecessary limitations should be understood therefrom, as modifications will be obvious to those skilled in the art.

What is claimed is:

1. A tape feed device for a sewing machine for feeding to a sewing location of the sewing machine at least one tape from a supply comprising, a drive roll for feeding the tape, a feed roll disposed in the path of the tape between the supply and the drive roll, a stepping motor for driving both the drive roll and the feed roll, and guide means for passing tape around at least part of the feed roll, with said feed roll having means for feeding more tape than the drive roll, wherein the feed roll and the drive roll are journalled in respective holding members which are connected together in an articulated manner.

2. A tape feed device as claimed in claim 1, in which the holding member for the feed roll is pivotally mounted on a housing of the sewing machine and is resiliently retained in predetermined registered positions relatively thereto.

3. A tape feed device as claimed in claim 1, in which knives for cutting the tape are disposed in the region of the drive roll.

4. A tape feed device as claimed in claim 3, including a piston and cylinder mechanism for actuating the knives.

5. A tape feed device as claimed in claim 1, in which the means for feeding more tape is defined by the feed roll having a greater diameter than the drive roll.

6. A tape feed device for a sewing machine for feeding at least one tape to a sewing location of the sewing machine comprising:

a.supply of tape;

a drive roll for feeding the tape;

a feed roll disposed in the path of the tape between the supply and the drive roll;

means for driving both the drive roll and the feed roll; and guide means for passing tape around at least part of the feed roll with said feed roll having means for feeding more tape than the drive roll, said guide means comprising a pair of deflecting guides adjacent the feed roll around which the tape passes, with one of the deflecting guides having a pair of spaced adjusting rings located adjacent opposed sides of the tape.

7. A tape feed device for a sewing machine for feeding to a sewing location of the sewing machine at least one tape from a supply comprising, a drive roll for feeding the tape, a feed roll disposed in the path of the tape between the supply and the drive roll, stepping motor for driving both the drive roll and the feed roll, an d guide means for passing tape around at least part of the feed roll, with said feed roll having means for feeding more tape than the drive roll, in which knives for cutting the tape are disposed in the region of the drive roll.

8. A tape feed device for a sewing machine for feeding to a sewing location of the sewing machine at least one tape from a supply comprising, a drive roll for feeding the tape, a feed roll disposed in the path of the tape between the supply and the drive roll, a stepping motor for driving both the drive roll and the feed roll, and guide means for passing tape around at least part of the feed roll, with said guide roll having means for feeding more tape than the drive roll, said means being defined by the feed roll having a greater diameter than the drive roll.

* * * * *